United States Patent [19]

Fujii et al.

[11] 4,056,412

[45] Nov. 1, 1977

[54] METHOD FOR HARDENING STEEL PIPES

[75] Inventors: Yoshihisa Fujii; Akio Fujiwara, both of Wakayama, Japan

[73] Assignee: Sumitomo Metal Industries Limited, Osaka City, Japan

[21] Appl. No.: 612,927

[22] Filed: Sept. 12, 1975

Related U.S. Application Data

[62] Division of Ser. No. 471,543, May 20, 1974, Pat. No. 3,937,448.

[51] Int. Cl.[2] ..... C21D 9/08

[52] U.S. Cl. ..... 148/153; 148/157

[58] Field of Search ..... 148/143, 145, 153, 157

[56] References Cited

U.S. PATENT DOCUMENTS

| | | | |
|---|---|---|---|
| 2,295,272 | 9/1942 | Somes | 148/143 |
| 3,294,599 | 12/1966 | Huseby | 148/143 |

*Primary Examiner*—R. Dean

[57] ABSTRACT

This invention relates to a method wherein the setting angles of cooling water jetting orifices an outer quenching head and an inner quenching head are made $30° \pm 10°$ in the pipe advancing direction with the pipe axis and the number of jetting orifices of the inner quenching head are greater for purposes of higher density for the front one-third of the length of the head and lower for purposes of lower density for the rear two-thirds of the length of the head.

Further, the first contact point of inner quenching water within the inner surface of the pipe is so set as to be delayed by 20 to 150mm. from the first contact point of quenching water with the outer surface of the pipe, the outer quenching being carried out when the steel pipe heating temperature is above the $A_3$ transformation point and the inner quenching is carried out when the temperature of the inner surface of the pipe is just below the $A_1$ transformation point.

As both heads have a fixed angle, water or steam will not enter the unquenched part and the quenching velocity and the hardness of the cross-section of the steel pipe will be improved.

3 Claims, 6 Drawing Figures

METHOD FOR HARDENING STEEL PIPES

This is a division of application Ser. No. 471,543 filed May 20, 1974, U.S. Pat. No. 3,937,448.

This invention relates to improvements in a method for hardening steel pipes by jetting quenching water on the inner surface and the outer surface of a steel pipe, and defines a hardening method wherein a martensite crystal structure homogeneous over the entire thickness of the pipe is obtained quickly and positively with a limited amount of quenching water.

The hardening of steel pipes with quenching water has been conventionally carried out by arranging an outer quenching head having many quenching water jetting orifices on the inner peripheral surface, and a cylindrical inner quenching head having many quenching water jetting orifices on the outer peripheral surface so that the quenching water jetted inwardly and outwardly may contact the same relative parts on the inner surface and the outer surface of the steel pipe while jetting the quenching water simultaneously out of both quenching heads simultaneously with the movement of the steel pipe.

It is known that, in such method of quenching a pipe simultaneously from the inner and outer surfaces, as compared with quenching only the outer surface, the quenching velocity is higher, the hardening effect is superior and a hardened steel pipe of a more stabilized quality is obtained.

An object of the present invention is to provide a method so improved that the quenching velocity and hardening effect may be increased.

In a conventional hardening apparatus, inner and outer quenching heads are provided with many jetting orifices so that quenching water may be jetted always at right angles. However, in such case, more quenching water than is required will be used, therefore it is not economical, a large amount of steam generated by quenching water fills the unquenched part and causes a fluctuation of the surface hardness, and there has been a problem that a homogeneous hardness is hard to obtain the entire cross-section of the steel pipe. In order to eliminate such defects, the present invention is characterized in that quenching water jetting orifices of an outer quenching head and an inner quenching head are made to have an angle of $30° \pm 10°$ in the pipe advancing direction with the pipe axis, the number of jetting orifices of the inner quenching head being arranged to be high to effect a high density for the front one-third of the length of the head and to be low in number to effect a low density for the rear two-third of the length of the head. A conical body preventing water at the time of quenching from entering the unquenched part is provided in the head part of the inner quenching head so that water may be prevented by this conical body from being reversed by the pressure of steam generated in quantities. The inner and outer quenching heads are so arranged that the first contact point of the inner quenching water with the inner surface may be delayed by 20 to 150mm. from the first contact point of the outer pipe surface quenching water with the outer surface, and the steel pipe is quenched at a temperature just below the $A_1$ transformation point. Thus the effective hardening of the inner surface of the pipe will be possible with a limited very small amount of quenching water and an excellent effect will be developed in hardening steel pipes.

Figure 1:
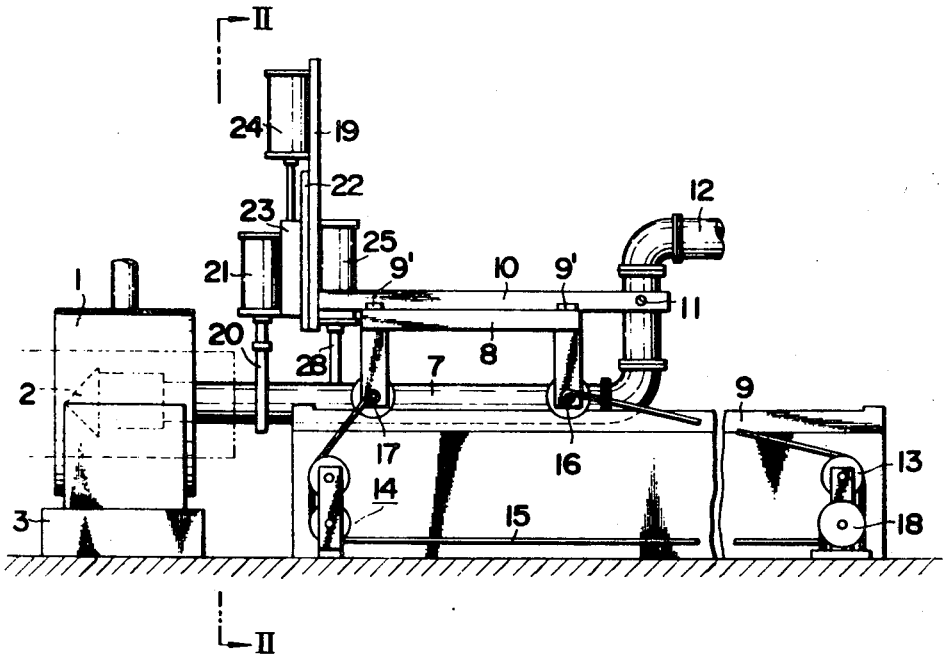
FIG. 1 is a side elevational view showing an embodiment of the present invention.
Figure 2:
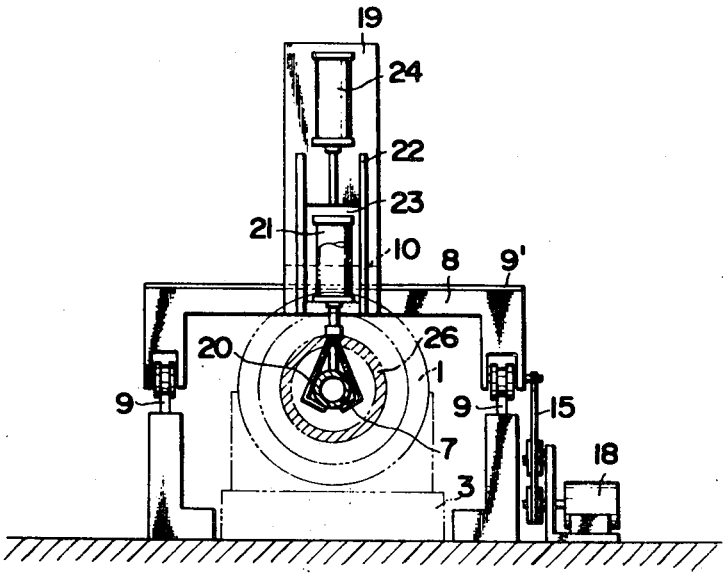
FIG. 2 is a vertically sectioned front elevational view taken substantially along II—II of FIG. 1.
Figure 3:
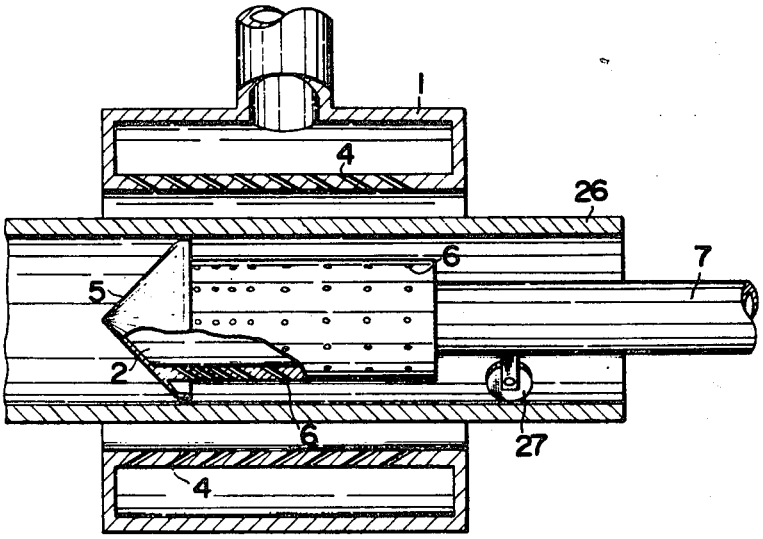
FIG. 3 is an enlarged vertically sectioned view showing the outer quenching head and the inner quenching head of FIG. 1.
Figure 4:
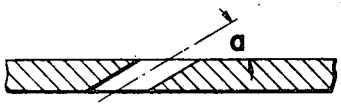
FIG. 4 is a detail view showing the angle of inclination of a quenching water jetting orifice.

In FIG. 1, 1 is an outer quenching head integrally mounted on a fitting base 3 fixed near a steel pipe 26 of a spirally feeding apparatus (not illustrated). Quenching water jetting orifices 4 of this outer quenching head are provided at fixed intervals with an angle $\alpha$ of $30° \pm 10°$ in the pipe advancing direction with the pipe axis as shown in FIG. 4. The reasons for jetting quenching water at such an angle $\alpha$ are to maintain a correlation with an inner quenching head and to prevent quenching water from flowing back to the unquenched part. As shown in FIG. 3, an inner quenching head 2 is provided with a conical body 5 at the tip to prevent quenching water from flowing back and steam generated at the time of quenching from flowing into the unquenched part. Quenching water jetting orifices 6 are so arranged as to be greater in number so as to effect a higher water jetting density for the front one-third of the length of the head and lower in number so as to effect a lower water jetting density for the rear two-third of the length of the head. The setting angle of said jetting orifices is made at $30° \pm 10°$ rearwardly in relation to the pipe axis so that the quenching water of the inner quenching head may be jetted first at a high density and then at a low density. The reason for dividing the amount of jetted quenching water in such manner is that, as both inner and outer quenching heads are immovable and the pipe proceeds rearwardly to be successively quenched, in case the head body is particularly short, the problem will be different but, when it has some length, in case the jetting orifices are at fixed intervals over the entire head, the first quenched part will be sprayed again with more quenching water than is required and a loss will be caused to the quenching water. Therefore, if the quenching water is jetted first at a high density and then at a low density, the amount of the quenching water may be small and a favorable quenching will be able to be made.

The above mentioned inner quenching head 2 is fitted to a boom 7 which is a long tubular conduit. Said boom is mounted to a movable stand 10 as at 11, the stand being mounted on cross members 9' of a carriage 8 which is movable along the direction of conduit axis. Carriage 8 is mounted on rails 9 and has a rope 15 extended over two sets of pulleys 13 and 14 arranged on a floor, the rope being secured at its respective ends to a front axle 16 and a rear axle 17 of the carriage wheels. The carriage is movable forwardly and rearwardly in the conduit axis, by means of a normal and reverse motor 18 mounted on one of the direction of the pulley bearings so that the relative positions of the inner quenching head 2 and outer quenching head 1 may be adjusted at a high precision. Needless to say, the above mentioned adjusting means is not limited only to a pulley system. A vertical plate 19 is fixed at the forward end of stand 10 so that the movable stand 10 and vertical plate 19 may be moved together. Vertically disposed rails 22 are secured to the front surface of plate 19, and a base plate 23 is mounted for vertical movement along rails 22. A boom gripper opening and closing cylinder 21, having a boom gripper 20, is fixedly secured to plate 23 so as to be vertically movable together therewith along rails 22. Said base plate 23 is supported by a boom elevating and lowering cylinder 24 fixed to the upper part of vertical plate 19. A boom height adjusting cylinder 25 is fitted to the back surface of the vertical plate. A rod 28 of boom height adjusting cylinder 25 is disposed in contact at one end with the outer periphery of boom 7 so as to prevent boom 7 from moving upwardly. As the upward and downward movements of the steel pipe are regulated respectively by rod 28 and gripper 20, cylinders 24 and 25 act to center inner quenching head 2 also to hold boom 7 for a fixed period.

In operation boom 7 is held at a fixed height by means of boom gripper opening and closing cylinder 21, elevating and, lowering cylinder 24 and height adjusting cylinder 25. Then, inner quenching head 2 is inserted into outer quenching head by means of carriage driving motor 18 and is so positioned that the first contact point of the jetted quenching water with the inner surface may be delayed by 20 to 150mm. from the first contact point of the quenching water with the outer surface. Such position of the inner quenching head is properly determined by the outer diameter, thickness and feeding velocity of the steel pipe. The heated steel pipe 26 comes out of a furnace, passes through the outer quenching head 1 and passes over inner quenching head 2. In such case, when the steel pipe enters the quenching range, it must be at a temperature at which a transformation to a desired uniform crystallographical structure occurs, that is, a temperature not lower than the $A_3$ transformation point. Thus, when the steel pipe comes into the quenching range, first the quenching water will be jetted out of the outer quenching head to quench the outer surface and, when the inner surface temperature lowers to be just below the $A_1$ transformation point, the quenching water will be jetted out of the inner quenching head 2. This quenching water jetting time difference is set on the basis of experimental data values obtained in advance so as to conform to the thickness, outer diameter and feeding velocity of the steel pipe. When the quenching commences, the boom gripper opening and closing cylinder 21 will be opened, the base plate 23 and rod 28 will be elevated by the boom elevating and lowering cylinder 24 and boom height adjusting cylinder 25 and the holding of the boom 7 will be released. On the other hand, the boom will become free but will be positioned in the center of the steel pipe by the pressure of the quenching water jetted out of the head and the rollers 27 near the nozzle. During quenching, the quenching water of both inner and outer quenching heads will be jetted rearwardly at an angle of $30° \pm 10°$ with the pipe axis. The quenching water will be prevented by the action of conical body 5 in the head part of the inner quenching head from flowing into the unquenched part by the pressure of steam. Therefore, there will be no temperature change by the back flowing quenching water and steam and a stabilized quenching will always be able to be made.

Figure 5:
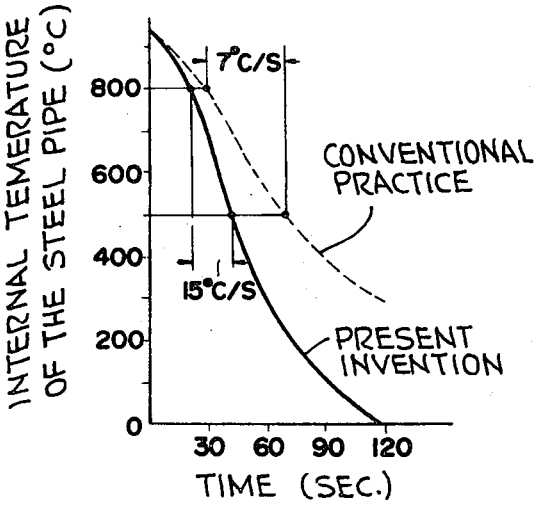
FIG. 5 is a graph showing examples of quenching velocities of steel pipes with the use of the present invention and in conventional practice.
Figure 6:
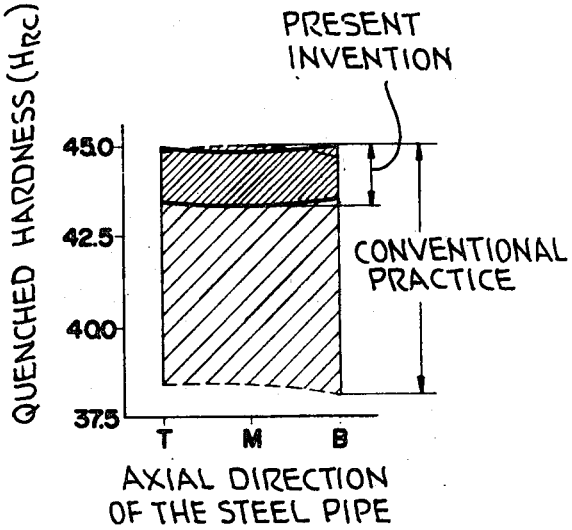
FIG. 6 is a graph showing the hardness of the cross-section of a steel pipe.

In the present invention, as mentioned above, the inner surface is quenched by jetting quenching water first at a high density and then at a low density. According to this method, an effective quenching can be made with a limited small amount of quenching water. This can be proved with the graphs shown in FIGS. 5 and 6. That is to say, FIG. 5 shows examples of the quenching velocities of steel pipes. As is evident from said graph, it is found that, in the case of quenching inner and outer surfaces in the present invention, the quenching velocity is increased to be more than twice as high as in conventional practice. Accordingly as shown in FIG. 5, the hardness of the cross-section of a thick walled steel pipe when quenched which fluctuated by HRC 30 14 before was improved even to HRC + 2. Thus a steel pipe of a very stable high quality in any position was obtained.

After the steel pipe comes completely out of the heating furnace and is completely quenched, the carriage is retreated by the driving normal and reverse motor 18 so that inner quenching head 2 may be released from the steel pipe. Then, the boom gripper opening and closing cylinder 21 is retracted upwardly so as not to interfere with the advance of the steel pipe and is lowered by the elevating and lowering cylinder 24 above it so that boom 7 is gripped and held with by gripper 20. In such position, the movable stand 10 is moved laterally along the rails 9 so that inner quenching head 2 may be positioned out of the pipe feeding path. Then, the quenched steel pipe is advanced to the next stop.

As explained above, in the present invention, the quenching water jetting angles of both inner and outer quenching heads are set to be at an angle of $30° \pm 10°$ with rearwardly the pipe axis, the quenching water jetting orifices of the inner respect to quenching head are so arranged as to be high in density for the front one-third of the length of the head and low in density for the rear two-third of the length of the head, and a conical body which prevents quenching water from flowing back and steam from flowing into the unquenched part is provided at the forward end of the head. Accordingly the surface of the steel pipe can be effectively quenched with a limited very small amount of quenching water, the quenching water can be saved, and the quenching characteristics are very excellent as evident from the graphs in FIGS. 5 and 6. A tempered martensite structure high in the anti-sulfide corrosion breakability is therefore positively obtained for the inner surface of the pipe and a great effect is developed in the production of quenched steel pipes of a high quality.

What is claimed is:

1. A method of hardening steel pipes by quenching the inside surface and the outside surface of a steel pipe by jetting quenching water from the outside and inside of the pipe comprising, a first quenching step of jetting quenching water to the outside surface of the steel pipe at an angle of $30° \pm 10°$ in the pipe advancing direction of the pipe axis, said first step commencing when the steel pipe has a heating temperature above the $A_3$ transformation point, and a second quenching step of jetting quenching water to the inside surface of the steel pipe at an angle of $30° \pm 10°$ in the pipe advancing direction of the pipe axis, said second quenching step commencing when said inside surface of the steel pipe is just below the $A_1$ transformation point and the quenching water being jetted during said second quenching step first at a predetermined density and thereafter at a density lower than said predetermined density.

2. A method of hardening steel pipes according to claim 1, wherein said first and second quenching steps are carried out while preventing water and steam from entering the unquenched part.

3. A method of hardening steel pipes according to claim 1, wherein said quenching steps are so carried out that the jetted quenching water at a point of first contact with said inner surface is delayed by 20 to 150 mm from a point of first contact of the jetted quenching water with said outside surface.

* * * * *